US006357947B1

(12) United States Patent
Mark

(10) Patent No.: US 6,357,947 B1
(45) Date of Patent: Mar. 19, 2002

(54) APPLICATOR HAVING A BREAK AWAY CUP

(76) Inventor: Phillip Mark, 1255 LaQuinta Dr. #214A, Orlando, FL (US) 32809

( * ) Notice: Subject to any disclaimer, the term of this patent is extended or adjusted under 35 U.S.C. 154(b) by 0 days.

(21) Appl. No.: 09/962,150

(22) Filed: Sep. 26, 2001

(51) Int. Cl.[7] ..... B43K 5/00

(52) U.S. Cl. ..... 401/207; 401/202; 401/130; 15/104.93; 15/104.94

(58) Field of Search ..... 401/202, 207, 401/126, 130; 15/104.93, 104.94; 132/317

(56) References Cited

U.S. PATENT DOCUMENTS 2,774,984 A * 12/1956 Morrell ..... 15/104.93
4,711,354 A * 12/1987 Bennett ..... 401/130
5,826,600 A * 10/1998 Rowe et al. ..... 401/129
6,039,487 A * 3/2000 Kristiansen ..... 401/126

* cited by examiner

*Primary Examiner*—David J. Walczak
(74) *Attorney, Agent, or Firm*—Eric P. Schellin

(57) ABSTRACT

An applicator that has an elongated tubular handle with a proximate and a distal end. The distal end has a dauber of a foamed material which is coextensive with said handle and has a diameter the same as said tubular handle, the formed material is cylindrical thereby providing a recess which is preloaded with a to-be-dispensed liquid. The handle is provided with an annular ring. A cup with a mouth portion is mounted about the foamed material. The mouth portion is affixed to said outer circumference of said ring. The cup has an annular weakened score line whereby said cup may be broken away to expose said foamed material.

4 Claims, 1 Drawing Sheet

APPLICATOR HAVING A BREAK AWAY CUP

FIELD OF THE INVENTION

It has been deemed propitious to provide relatively small liquid applicators that are for a single use. These applicators usually employ a tubular rod-like handle which may be hand held. The distal end of such an applicator terminates in a brush or some sort of acceptable dauber. Such a device requires successively dipping the bristle end or dauber repeatedly in the to-be applied liquid.

In some instances such use is unacceptable for fear of unwarranted contamination that may ensue.

In other instances, the applicator is provided with a reservoir whereby additional to-be applied liquid is dispensed from the reservoir to the applicator end. Such a device may have available too much liquid for the task, resulting in the need to dispose any remaining quantity.

PRIOR ART

The prior art has been replete with attempts to provide an applicator having a quantity of liquid for use through a dauber. For instance, U.S. Pat. No. 4,035,090 to Bavaveas; U.S. Pat. No. 5,054,948 to Honda et al; U.S. Pat. No. 5,131,777 to Junji et al and U.S. Pat. No. 5,577,851 to Koptis are prior art attempts but do not solve the attendant problem.

DETAILED DESCRIPTION OF THE INVENTION

Figure 1:
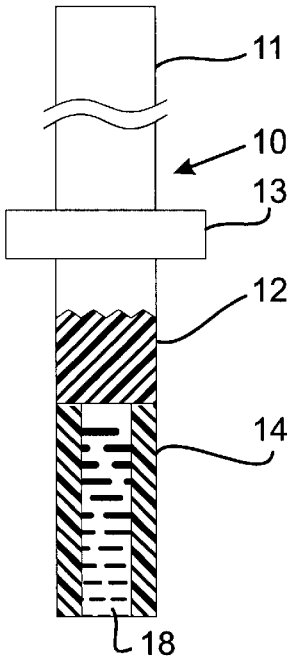
FIG. 1 is a side elevation of the device of the present invention with a portion thereof in cross-section.

FIG. 1 depicts the device of the present invention, generally, with reference numeral 10. The device has an elongated applicator rod handle 11 as the proximate end and a distal end 12. Near the said distal end 12 is a radially outwardly extending annular ring 13. The device is injection molded.

The distal end portion 12 is coextensive with the rod handle 11 and depicts a cylindrical distally extending member 14. The said member is of a foam material which is also injection molded. The injection molding is carried out in a well known manner of providing a mold into which is injection serially a thermoplastic material to comprise the handle and annular ring 13 followed by injection molding the foam material. It is noted that the foam material can be serially injection molded either before or after the injection of the rod handle.

Figure 2:
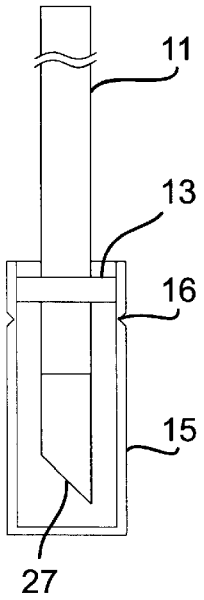
FIG. 2 is the side elevation showing the device encapsulated with a cup.

FIG. 2 the device is shown with a cup 15 which extends from the ring 13 and about the foam material 14 and in spaced relationship therewith. The cup 15 is of a thermoplastic material. The cup 15 has an internal diameter whereby it frictionally engages the outer circumference of the annular ring 13. The cap is secured to the said ring 13 by conventional adhesive means or may be welded thereonto by radio energy of a conventional type.

The said cup 15 has an annular weakened area 16 relatively close to the annular ring 13. When it is desired to free the cup 15 from the device the cup is broken along said weakened area and the applicator is removed from the cup leaving an annular portion 17 to remain on the ring 13.

Internally, The cylindrical foam material 14 is loaded with a viscous liquid 18 as depicted in FIG. 1. It is contemplated that the applicator will be loaded with the liquid 18 prior to the affixing and sealing the cup 15 thereonto, thereby providing a self-contained preloaded disposable applicator.

Of course it is also contemplated that the applicator may not be loaded with a liquid until after it is unfurled from its cup. The applicator may be then employed by dipping the foam material portion 14 in a liquid, then withdrawn. The liquid is then distributed onto a substrate much in the manner of a small brush. As the liquid is depleted from the foam material portion 14 the applicator may then be dipped into a reservoir of additional coating liquid to replenish the foam material with liquid.

Figure 4:
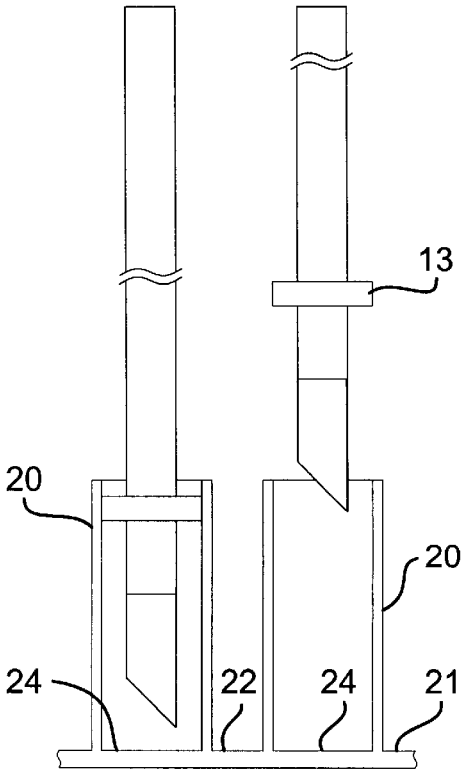
FIG. 4 shows a stand with a plurality of said devices with an applicator being removed.

FIG. 4 depicts the present invention wherein a plurality of applicators each of which is set into cylindrical receptacles 20 on upstanding stand 21 which has a base 22. The diameter of the receptacles are such whereby the ring 13 slidably fits thereinto. The foam material is spaced from the bottom 24. The outer circumference is tightly embraced by the inner wall of the cylindrical receptacle 20.

In this matter a plurality of applicators are presented for use in an array.

Figure 3:
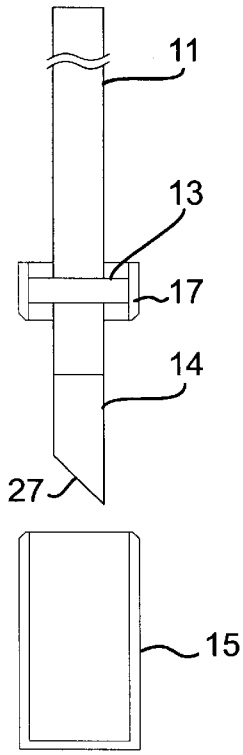
FIG. 3 is the device as shown in FIG. 2 where a cup has been severed therefrom.
Figure 5:
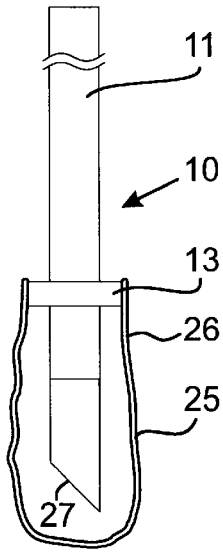
FIG. 5 is another embodiment with a flexible bag shielding the applicator.
Figure 6:
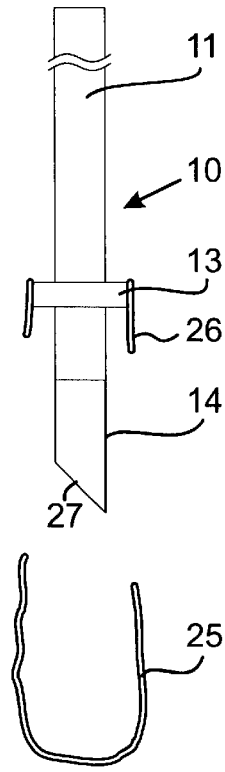
FIG. 6 is the embodiment of FIG. 5 where the bag has been broken away.

Attention is now directed to FIGS. 5 and 6 for an alternative embodiment of the present invention. Instead of the cylindrical receptacle as in FIGS. 2 and 3 a flexible bag 25 is affixed at its month portion 26 to the ring 13. The bag is fabricated of a film plastic material which may be readily torn leaving the mouth portion 26 of the bag in place.

The foam material is depicted as having a lowermost beveled portion 27.

In use, the foam material beveled end portion acts as a dauber for distribution of the viscous ligand as appropriate.

The liquid applicator of the present invention can find a wide use such as for medical liquid agents. It can also be employed for use as an applicator for applying a cosmetic liquid such as a manicure liquid, a lip cream or eye liner, an applicator for applying an office use liquid such as paste or correction liquid, as well as a marking and painting liquid, an applicator for applying a cooking oil or the like to a cooking instrument, an applicator of a liquid for matching such as a lubricant, and applicators of various other liquid such as a wax, detergent, shoe shining cream etc.

What is claimed is:

1. An injection molded applicator comprising an elongated rod handle, said handle having an outwardly extending annular ring, said rod handle terminating in a coextensive extending cylindrical member of substantially the same diameter as the diameter as said rod handle, said member being a foamed material, said foamed cylindrical member being preloaded with a viscous liquid, said applicator having an open-ended cup having a mouth portion, said mouth portion adapted and constructed to snugly fit about said annular ring, said cup being spaced from said foamed material, said cup having a weakened annularly disposed score line whereby the cup may be broken away from the applicator to expose the foamed material of the applicator.

2. The applicator of claim 1 wherein the foamed material is serially injection molded either before or after the injection of said rod handle.

3. The applicator of claim 2 wherein injection molded material comprising said rod handle is a thermoplastic.

4. The applicator of claim 1 wherein the cup is vertically affixed to a base substrate to form an array of applicators.

* * * * *